United States Patent [19]

Ramsauer et al.

[11] 3,990,416

[45] Nov. 9, 1976

[54] ENGINE IGNITION DISTRIBUTOR WITH MAGNETICALLY HELD TIMING SHIFT PLATE

[75] Inventors: Sepp E. Ramsauer, Schwieberdingen; Hubert Schratz, Hinterstein; Herbert Mägdefrau, Sonthofen; Heinz Berger, Stuttgart; Erich Pechatschek, Blaichach; Uwe Kröger, Hofingen; Harald Kalippke, Hohenacker; Jörg Issler, Stuttgart, all of Germany

[73] Assignee: Robert Bosch G.m.b.H., Stuttgart, Germany

[22] Filed: Aug. 7, 1975

[21] Appl. No.: 602,576

[30] Foreign Application Priority Data

Aug. 14, 1974 Germany ..... 2438993

[52] U.S. Cl. ..... 123/117 A; 123/146.5 A; 200/31 DP; 200/31 V

[51] Int. Cl.[2] ..... F02P 5/10

[58] Field of Search..... 123/117 R, 117 A, 146.5 A; 200/31 V, 31 DP

[56] References Cited

UNITED STATES PATENTS 3,688,392 9/1972 Cooksey ..... 200/31 V

FOREIGN PATENTS OR APPLICATIONS 1,182,444 2/1970 United Kingdom..... 200/31 V

*Primary Examiner*—Robert G. Nilson
*Attorney, Agent, or Firm*—William R. Woodward

[57] ABSTRACT

An annular permanent magnet affixed to the bottom of the timing shift plate of an ignition distributor exerts a force attracting the timing shift plate to the fixed carrier plate on which the timing shift plate is supported by spacers. Another permanent magnet is set into the inner flange of the carrier plate in the neighborhood of the cam-following portion of the interruptor to attract the nesting inner flange of the timing shift plate, so as to prevent the play between these flanges which form the bearing for the timing shift plate from interfering with the ignition timing. The timing shift plate and carrier plate are made of iron and there is only a small gap between the outer peripheries to provide a return magnetic circuit.

11 Claims, 3 Drawing Figures

ENGINE IGNITION DISTRIBUTOR WITH MAGNETICALLY HELD TIMING SHIFT PLATE

This invention relates to a distributor for internal combustion engines and more particularly the type of distributor in which an ignition timing shift plate is mounted shiftably in rotation on a carrier plate to allow shifting of interruptor contacts of an engine ignition system around a rotating distributor cam in response to a device that measures engine intake vacuum. The carrier plate provides a bearing for the timing shift plate, the latter being spaced from the carrier plate by suitable sliding spacers and being arranged to be actuated to move in an arc around the cam by an actuating rod from the vacuum-responsive device.

Such ignition distributors make it possible to shift the ignition timing in response to the intake vacuum and thereby to adjust the timing properly to the engine load when the engine is operating at less than full load.

In a known type of ignition distributor (according to German Pat. No. 1,273,905) the timing shift plate is pressed against the carrier plate by a pressure member in order to prevent the timing plate from being tipped or flipped up when actuated to shift timing, thereby disturbing the adjustment of the timing. The pressure member in this case is subjected to the force of a correspondingly bent leaf spring fastened to the carrier plate.

Various shortcomings have been found in the abovedescribed known form of distributor, for example, the difficulty that the effect of the pressure member is to provide relatively higher frictional resistance that must be overcome in operating the timing shift plate, and further that the construction is bulky and wasteful of space and, finally, that the precision of adjustment is subject to difficulties as a result of the pressure applied by the springs and unreliability because of the aging of the springs.

It is an object of the present invention to provide a distributor usable with currently available types of underpressure devices responsive to engine vacuum in which the above-described shortcomings are overcome or eliminated.

SUBJECT MATTER OF THE PRESENT INVENTION

Briefly, the ignition timing shift plate is arranged to be attracted towards the carrier plate by magnetic force, thus eliminating any necessity for the provision of springs. In a particularly advantageous form of the invention the magnetic force is provided by an annular permanent magnet, preferably of rectangular cross section with a width greater than the thickness, the cross-sectional width being defined as the radial dimension and the thickness as the axial dimension. The magnet is preferably a permanent magnet made of plastoferrite and, although it may be affixed either to the carrier plate or to the ignition timing shift plate, it is preferred to affix it to the ignition timing shift plate, because it is easy to provide a uniform opposing surface of the carrier plate (across a small air gap) uninterrupted by perforations or other structural discontinuities.

In an improved version of the invention, an auxiliary force, preferably likewise a magnetic force, is provided to be exerted on a portion of the periphery of the timing shift plate to counteract the effect of play in the rotary bearing provided by the mutually engaging inner annular flanges of the timing shift plate and carrier plate respectively. This auxiliary force can conveniently be provided by a plastoferrite permanent magnet set in a portion of said annular flange of the carrier plate. The carrier plate also has an outer annular flange coming close to the edge of the timing shift plate to complete the magnetic circuit and provided with tabs for attachment to the distributor case.

The invention is further described by way of illustrative example with reference to the accompanying drawings, in which.

Figure 1:
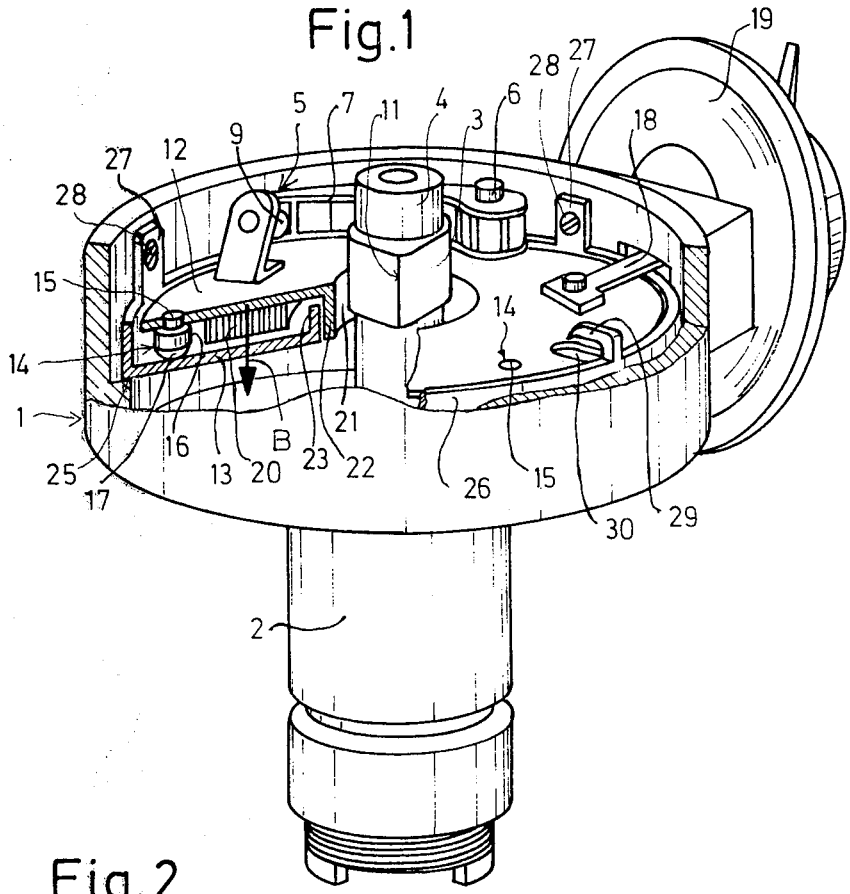
FIG. 1 is a perspective view, partly broken away, of the portion of an internal combustion engine distributor embodying the invention.

The distributor shown in the drawings is designed to operate as part of the ignition system, the rest of which is not shown, of a multi-cylinder internal combustion engine. The distributor has a pot-shaped distributor casing 1 on the bottom of which is provided a downwardly extending bearing housing 2 in which the distributor camshaft is mounted that carries a cam 3 secured by a collar 4. The camshaft, of course, is arranged to be coupled to the engine that is not shown and to be set thereby into rotation when the engine operates.

Figure 3:
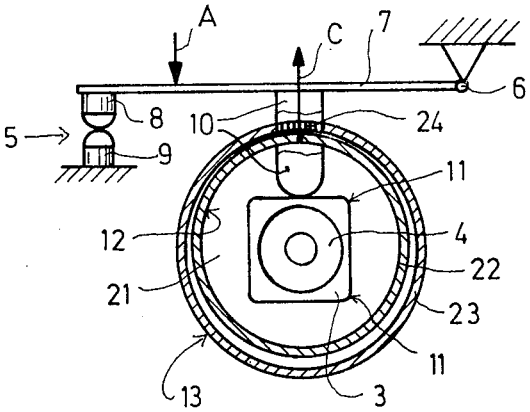
FIG. 3 is an axial view, partly diagrammatic and partly in cross section, of a portion of the distributor of FIG. 1.

An ignition signal initiating device, in the illustrated case an interruptor switch 5, is operated by the distributor cam 3. The interruptor switch 5 (FIGS. 1 and 3) has a contact arm 7 pivoted on a stud 6 and provided with a contact 8 at its free end that normally rests against a fixed contact 9 but is removed from contact therewith when a cam follower element 10 provided on the side of the contact arm 7 facing the cam 3 and sliding against it engages one of the rounded corner edges 11 of the cam 3.

The interruptor 5 is mounted on a timing shift plate 12, which in turn is rotatably held on the carrier plate 13 in a manner more particularly described below. The carrier plate 13 is fastened to the distributor casing 1 in such a way that the plane of the carrier plate is a cross-sectional plane of the distributor casing 1, as is likewise the plane of the timing shift plate 12, which is to say that both of these plates 12 and 13 are perpendicular to the axis of the distributor casing and camshaft.

The timing shift plate 12 is supported on the carrier plate 13 by spacers 14 in order to maintain a definite spacing between the two plates. The spacers 14, of which two are visible in the drawing, are affixed to the timing shift plate 12 and spaced from each other in the circumferential direction by an angle of approximately 120°. In the illustrated case they have the form of a cylindrical stud having a short extension 15 of smaller diameter seated in a perforation of the timing shift plate 12 and a stud body 16 of larger diameter with a rounded end 17 serving as a support surface that bears against the carrier plate 13.

The timing shift plate 12 can be rotated relative to the carrier plate 13 around the cam 3 and is actuated so to rotate by the timing shift drive rod 18 of an underpressure sensor unit 19 that is exposed to the vacuum condition in the carburetor air intake (not shown) of the engine. In order to prevent tipping, jamming or flipping up of the timing shift plate 12 by the actuating rod 18 and consequent disturbance of the load-dependent ignition timing adjustment, the timing shift plate is exposed to the effect of a magnetic force B that attracts the timing shift plate 12 towards the carrier plate 13. The magnetic force B in the preferred embodiment of the invention here illustrated is produced by a ring-shaped magnet structure 20 that is fastened to one of the opposedly facing surfaces of the timing shift plate 12 and the carrier plate 13 (in the illustrated case the former) and this force is directed perpendicularly to the planes of these plates 12 and 13, thus in the direction of the vertical shading on the drawing applied to the cross section of the magnet 20. A central passage 21 is provided passing through the centers of the timing shift plate 12, the carrier plate 13 and of course the annular magnet 20, so that these structures encircle the camshaft and its cam 3 and collar 4 which freely pass through this passage 21.

The annular magnet structure 20 can have the geometric form of a full ring or it may be composed of ring arcs that are spaced from each other in the circumferential direction. It is particularly effective to make the annular magnetic structure 20 of a permanent magnet body, because in this case — in contrast to that of an electromagnet – no electrical connections interfering with its function are necessary. So-called plastoferrite magnetic material (ferrite held or dispersed in a synthetic resin body) is particularly well suited as the magnetic material for such a permanent magnet.

Figure 2:
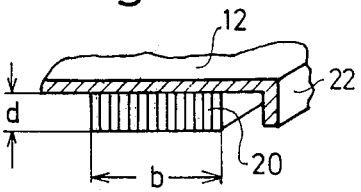
FIG. 2 is a detail view, partly in cross section and partly in broken away perspective, of a portion of the timing shift plate of the distributor of FIG. 1.

In order to hold the axial dimension, which is usually the vertical dimension, to a low value, the radial cross section of the annular magnet structure 20 should be rectangular, with a greater width b than (vertical) thickness d (FIG. 2).

It is more practical to affix the annular magnet 20 to the timing shift plate 12 than to the carrier plate 13, because the former must usually have a number of holes and similar discontinuities required by its functions, whereas the carrier plate 13, on the contrary, is free of such discontinuities, so that a uniformly distributed effect of the magnetic force B can thus be obtained. In the simplest case the annular magnet 20 can be glued onto the timing shift plate 12.

The timing shift plate 12 and the carrier plate 13 are made of a magnetically conducting material, preferably iron.

In order to assure a sufficiently precise rotary movement of the timing shift plate 12, an annular flange 22 is provided on the timing shift plate 12 around the central opening 21, the flange 22 being at right angles to the plane of the timing shift plate and extending towards the carrier plate 13, which also is provided with such a flange 23 extending towards the timing shift plate 12 in such a way that the two flanges nest loosely and provide a bearing, preferably with the flange 23 of the carrier plate 13 having the larger diameter as in the case illustrated, where the inner surface of the flange 23 of the carrier plate 13 faces the outer surface of the flange 22 of the timing shift plate 12. Furthermore, an outwardly directed auxiliary force C can readily be provided in this structure to compensate for the play in the bearing sufficiently to prevent any disturbing influence from being exerted on the timing shift as the result of the play in the bearing, the auxiliary force C being exerted on a portion of the annular flange 22 of the timing shift plate 12. In the illustrated case the auxiliary force C is produced by an additional magnet 24 that is set in the annular flange 23 of the carrier plate 13 in the neighborhood of the cam follower portion 10 of the interruptor switch 5. The magnet 24 is magnetized in the direction of the shading applied to the cross section of the magnet 24 shown in FIG. 3 and causes the flange 22 of the timing shift plate 12 always to assume a prescribed position opposite the flange 23 of the carrier plate 13.

The carrier plate 13, the seating of which in the distributor casing 1 is determined by a shoulder 25 of the casing, has another annular flange 26 at right angles to the carrier plate plane on its outer periphery that encircles the outer edge of the timing shift plate 12 with a small spacing between them and thus provides a return path for the magnetic circuit.

A simple way of mounting the carrier plate 13 is to provide axially projecting tabs 27 on the outer annular flange 26 of the carrier plate, spaced from each other in the circumferential direction, for example, by an angle of about 120°. the tabs 27 are preforated so that they may be fastened down by screws 28 screwed into the distributor casing 1.

In order to assure that the timing shift plate 12 will not be lifted or shaken out of place, the outer flange 26 of the carrier plate 13 is provided with inwardly extending projections 29 that grip the surface of the timing shift plate 12 which faces away from the carrier plate 13. The projections 29, of which only one is visible in the drawing, are spaced from each other circumferentially by about 120°and are shaped like bent fingers. In order that the projections 29 should not interfere with the mounting and unmounting of the timing shift plate 12, slots 30 are provided in the outer edge of the timing shift plate 12, of which one is visible in the drawing, arranged around the circumference at the same angular spacing as the projections 29. In assembly of the distributor, after the projections 29 have passed through the slots 30 in the course of mounting the timing shift plate 12, the timing shift plate is rotated so that the projections 29 can bear against the surface of the timing shift plate and then the screws 28 are screwed into the casing 1 through the tabs 27.

The above-described features make it possible to overcome to a satisfactory degree the shortcomings of the conventional distributor structures mentioned in the introduction to the specification.

Although the invention has been described with respect to a specific illustrative embodiment, it will be appreciated that variations are possible within the inventive concept.

We claim:

1. An engine ignition distributor comprising, in combination:

a rotatable distributor cam and camshaft;

a carrier plate arranged for fixed mounting in substantially symmetrical perpendicular relation to the rotational axis of said cam and camshaft;

an ignition timing shift plate carrying an ignition signal-initiating device arranged for operation by said distributor cam, said timing shift plate being supported on said carrier plate by spacing members so as to be rotatable with respect to said carrier plate and parallel thereto;

mechanical connection means on said timing shift plate for producing rotary displacement of said timing shift plate relative to said carrier plate over an arc of rotation in response to movement of an actuating member of an underpressure measuring means; and magnetic force exerting means (20) for continuously exerting a force (B) attracting said ignition shift timing plate (12) towards said carrier plate (13).

2. An engine ignition distributor as defined in claim 1, in which said magnetic force exerting means is in the form of an annular magnet body (20) affixed to one of the respective opposedly facing surfaces of said carrier plate (13) and said timing shift plate (12) and arranged to provide magnetization running in a direction perpendicular to the planes of said plate surfaces, and in which, further, both said carrier plate and said ignition shift plate are provided with a central aperture so as to provide a central opening (21) passing through both plates and encircled by said magnet body (20).

3. An engine ignition distributor as defined in claim 2, in which said annular magnet body (20) is a permanent magnet.

4. An engine ignition distributor as defined in claim 2, in which the radial cross section of said annular magnet body (20) is substantially rectangular and of greater width (b) than thickness (d), width being measured in the radial direction and thickness in the axial direction.

5. An engine ignition distributor as defined in claim 2, in which said central opening (21) is encircled by a flange (22) of said timing shift plate extending at right angles from said timing shift plate (12) towards said carrier plate (13) loosely nesting with a flange (23) of said carrier plate (13) extending towards said timing shift plate (12) so as to provide a bearing allowing relative rotation.

6. An engine ignition distributor as defined in claim 5, in which the outer circumference of said flange (22) of said timing shift plate (12) is arranged to face the inner circumference of said flange (23) of said carrier plate (13).

7. An engine ignition distributor as defined in claim 6, in which means are provided for exerting an outwardly directed force on a portion of said flange (22) of said ignition timing plate (12) for counteraction of the effect of play provided by said bearing.

8. An engine ignition distributor as defined in claim 7, in which said means for exerting an outwardly directed force on a portion of said flange of said ignition timing shift plate is constituted by a permanent magnet set in a portion of the adjacent flange (23) of said carrier plate.

9. An engine ignition distributor as defined in claim 2, in which said carrier plate (13) is provided also on its outer circumference with a flange (26) extending perpendicularly from said carrier plate (13) towards said ignition timing shift plate (12), which flange (26) encircles the outer edge of said timing shift plate at a small spacing therefrom.

10. An engine ignition distributor as defined in claim 9, comprising also a distributor casing (1) and in which said flange (26) on the outer circumference of said carrier plate (13) is provided with mounting tabs (27) extending axially from said flange (26) for mounting said carrier plate (13) on said casing (1).

11. An engine ignition distributor as defined in claim 9, in which said flange (26) on the outer circumference of said carrier plate (13) is provided with inwardly extending projections (29) so as to engage the surface of said timing shift plate (12) which is on the side thereof away from said carrier plate (13).

* * * * *